US007557681B2

(12) United States Patent
Whitaker et al.

(10) Patent No.: US 7,557,681 B2
(45) Date of Patent: Jul. 7, 2009

(54) ELECTRICAL SWITCHING APPARATUS ACCESSORY SUB-ASSEMBLY EMPLOYING REVERSIBLE COIL FRAME, AND ACCESSORY AND ELECTRICAL SWITCHING APPARATUS EMPLOYING THE SAME

(75) Inventors: Thomas A. Whitaker, North Huntingdon, PA (US); Erik R. Bogdon, Carnegie, PA (US)

(73) Assignee: Eaton Corporation, Cleveland, OH (US)

( * ) Notice: Subject to any disclaimer, the term of this patent is extended or adjusted under 35 U.S.C. 154(b) by 86 days.

(21) Appl. No.: 11/697,947

(22) Filed: Apr. 9, 2007

(65) Prior Publication Data

US 2008/0246564 A1 Oct. 9, 2008

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 9/00*** | (2006.01) |
| ***H01F 7/08*** | (2006.01) |

(52) U.S. Cl. ..... 335/14; 335/179; 335/220

(58) Field of Classification Search ..... 335/14, 335/220

See application file for complete search history.

(56) References Cited

U.S. PATENT DOCUMENTS

| | | | | | |
|---|---|---|---|---|---|
| 1,297,979 | A * | 3/1919 | Van Valkenburg | 335/183 |
| 1,306,638 | A * | 6/1919 | Shaw | 335/12 |
| 1,582,987 | A * | 5/1926 | Hart | 335/180 |
| 1,980,796 | A * | 11/1934 | Goff | 318/274 |
| 3,611,215 | A * | 10/1971 | Patel | 335/20 |
| 3,760,307 | A * | 9/1973 | Patel | 335/13 |
| 3,805,099 | A * | 4/1974 | Kelly | 310/12 |
| 3,815,633 | A * | 6/1974 | Greenwood et al. | 137/625.27 |
| 4,013,926 | A * | 3/1977 | Lang et al. | 361/115 |
| 4,540,154 | A * | 9/1985 | Kolchinsky et al. | 251/129.15 |
| 4,636,760 | A * | 1/1987 | Lee | 335/14 |
| 4,641,117 | A * | 2/1987 | Willard | 335/7 |
| 4,700,161 | A * | 10/1987 | Todaro et al. | 335/172 |
| 4,710,739 | A * | 12/1987 | Heyne et al. | 335/174 |
| 4,788,621 | A * | 11/1988 | Russell et al. | 361/115 |
| 4,876,521 | A * | 10/1989 | Boyd | 335/179 |
| 5,154,203 | A * | 10/1992 | Krause et al. | 137/116.3 |
| 6,166,616 | A * | 12/2000 | Fischer et al. | 335/172 |
| 6,232,855 | B1 * | 5/2001 | Malingowski et al. | 335/14 |
| 6,377,146 | B1 | 4/2002 | Batteux | |
| 6,388,859 | B1 * | 5/2002 | Turner et al. | 361/115 |
| 6,633,216 | B2 * | 10/2003 | Lewin et al. | 335/220 |
| 6,794,968 | B2 * | 9/2004 | Arnholt | 335/179 |
| 7,414,502 | B2 * | 8/2008 | Tackes et al. | 335/220 |
| 2006/0071740 | A1 * | 4/2006 | Bogdon et al. | 335/14 |

* cited by examiner

*Primary Examiner*—Elvin G Enad
*Assistant Examiner*—Alexander Talpalatskiy
(74) *Attorney, Agent, or Firm*—Martin J. Moran

(57) ABSTRACT

An electrical switching apparatus accessory sub-assembly is for an electromagnetic coil including a movable stem. The electrical switching apparatus accessory sub-assembly includes a coil frame having a first end and an opposite second end. A housing includes a plurality of interior surfaces, a first end and an opposite second end. The second end of the housing has an opening structured to receive the movable stem of the electromagnetic coil. A number of the interior surfaces of the housing are structured to selectively hold the coil frame in either one of a first position in which the coil frame first end faces the housing first end and the coil frame second end faces the housing second end, and a second position in which the coil frame first end faces the housing second end and the coil frame second end faces the housing first end.

16 Claims, 10 Drawing Sheets

ELECTRICAL SWITCHING APPARATUS ACCESSORY SUB-ASSEMBLY EMPLOYING REVERSIBLE COIL FRAME, AND ACCESSORY AND ELECTRICAL SWITCHING APPARATUS EMPLOYING THE SAME

CROSS-REFERENCE TO RELATED APPLICATION

This application is related to commonly assigned, concurrently filed:

U.S. patent application Ser. No. 11/697,944, filed Apr. 9, 2007, entitled "Electromagnetic Coil Apparatus Employing A Magnetic Flux Enhancer, And Accessory And Electrical Switching Apparatus Employing The Same".

BACKGROUND OF THE INVENTION

1. Field of the Invention

The invention pertains generally to accessory sub-assemblies for electrical switching apparatus and, more particularly, to shunt trip or under voltage release accessory sub-assemblies for circuit breakers. The invention also pertains to electrical switching apparatus accessories. The invention further pertains to electrical switching apparatus, such as, for example, circuit breakers including an accessory.

2. Background Information

Electrical switching apparatus, such as circuit breakers, as well as transfer switches, network protectors and the like, are often equipped with accessories such as, for example and without limitation, shunt trip devices and under voltage release (UVR) devices. Such devices can be employed in a variety of ways to initiate a change in status of the apparatus such as, for example, to trip open the separable contacts of the apparatus in response to an electrical fault condition (e.g., without limitation, current overload; short circuit; abnormal voltage) or other external condition.

In view of the increasing market trend to reduce the overall size of the circuit breaker, the space which is available within the circuit breaker housing is limited.

Referring to FIG. 1, typically, a shunt trip device 2 (or UVR device (not shown)) includes a number of coils 4, a frame 6, a plunger 8 and a heel 10, which cooperate to form a substantially closed magnetic circuit. A plunger stem 9 is further extended (not shown) in response to movement of the plunger 8 to, for example, engage and pivot a trip bar (not shown) to cause a circuit breaker (not shown) to trip open separable contacts (not shown). When one of the two example coils 4 is energized with a sufficient voltage, magnetic flux 12 is transferred through the ferrous parts of the magnetic circuit. As shown in FIG. 1, a south (S) magnetic pole is generated at the heel 10 and a north (N) magnetic pole is generated at the plunger 8. This attracts the plunger 8 to the heel 10 and causes the plunger to move.

Typically, a shunt trip device contains an instantaneous coil, which can only be energized during a relatively short period of time. A typical UVR device contains a relatively larger coil, and can be energized for continuous duty. The shunt trip plunger is actuated when sufficient voltage is applied, and the UVR plunger is released when voltage is removed. Because of this opposite functionality and strategy, known shunt trip and UVR devices do not use the same coil frame and the same molded housing.

Accordingly, there is room for improvement in electrical switching apparatus accessories.

There is also room for improvement in electrical switching apparatus that employ one or more accessories.

SUMMARY OF THE INVENTION

These needs and others are met by embodiments of the invention, which provide an electrical switching apparatus accessory housing that is structured to selectively hold a coil frame in either one of a first position in which the first end of the coil frame faces the first end of the housing and the second end of the coil frame faces the second end of the housing, and a second position in which the first end of the coil frame faces the second end of the housing and the second end of the coil frame faces the first end of the housing. This permits the same coil frame and the same housing to be employed for diverse accessories such as, for example, an under voltage release module and a shunt trip module.

In accordance with one aspect of the invention, an electrical switching apparatus accessory sub-assembly is for an electromagnetic coil including a movable stem. The electrical switching apparatus accessory sub-assembly comprises: a coil frame including a first end and a second end opposite the first end; a housing including a plurality of interior surfaces, a first end and a second end opposite the first end of the housing, the second end of the housing having an opening structured to receive the movable stem of the electromagnetic coil, wherein a number of the interior surfaces of the housing are structured to selectively hold the coil frame in either one of a first position in which the first end of the coil frame faces the first end of the housing and the second end of the coil frame faces the second end of the housing, and a second position in which the first end of the coil frame faces the second end of the housing and the second end of the coil frame faces the first end of the housing.

The housing may be structured to house either one of a shunt trip module including the coil frame and an under voltage release module including the same coil frame.

As another aspect of the invention, an electrical switching apparatus comprises: separable contacts; an operating mechanism structured to open and close the separable contacts; a trip mechanism structured to trip open the separable contacts, the trip mechanism including a trip bar; an enclosure enclosing the separable contacts; and an electrical switching apparatus accessory comprising: an accessory sub-assembly comprising: a coil frame including a first end and a second end opposite the first end, a housing including a plurality of interior surfaces, a first end and a second end opposite the first end of the housing, the second end of the housing having an opening, wherein a number of the interior surfaces of the housing are structured to selectively hold the coil frame in either one of a first position in which the first end of the coil frame faces the first end of the housing and the second end of the coil frame faces the second end of the housing, and a second position in which the first end of the coil frame faces the second end of the housing and the second end of the coil frame faces the first end of the housing, a coil assembly comprising a conduit, a number of coils within the coil frame and being disposed on the conduit, a ferrous plunger movable in the conduit, and a stem coupled to the ferrous plunger, a first ferrous member disposed proximate the first end of the coil frame, a second ferrous member having an opening and being disposed proximate the second end of the coil frame, and a circuit structured to energize at least one of the number of coils, wherein the stem is structured to pass through the opening of the housing, and wherein the stem is structured to engage the trip bar to trip open the separable contacts.

The electrical switching apparatus accessory may be a shunt trip module; the trip bar may be structured to pivot to trip open the separable contacts; the first ferrous member may be a ferrous heel having an opening therethrough; the second ferrous member may be a ferrous top plate; the stem may be a non-magnetic stem; the non-magnetic stem may pass through the opening of the ferrous heel; the coil assembly may further comprise a spring member biasing the ferrous plunger away from the ferrous heel; and when the circuit energizes the at least one of the number of coils, the ferrous plunger may be attracted toward the ferrous heel and the non-magnetic stem may be driven by the ferrous plunger externally through the opening of the housing to engage and pivot the trip bar to trip open the separable contacts.

The electrical switching apparatus accessory may be an under voltage release module; the trip bar may be structured to pivot to trip open the separable contacts; the first ferrous member may be a ferrous heel; the second ferrous member may be a ferrous top plate; the stem may be a non-magnetic stem; the non-magnetic stem may pass through the opening of the ferrous top plate; the coil assembly may further comprise a spring member biasing the ferrous plunger away from the ferrous heel; and when the circuit de-energizes the at least one of the number of coils, the ferrous plunger may be driven by the spring member away from the ferrous heel and the non-magnetic stem may be driven by the ferrous plunger externally through the opening of the housing to engage and pivot the trip bar to trip open the separable contacts.

The enclosure may include an accessory tray holding a number of electrical switching apparatus accessories including the electrical switching apparatus accessory.

The housing may be structured to house either one of: (i) a shunt trip module including the coil frame in the second position and the conduit of the coil assembly, and (ii) an under voltage release module including the same coil frame in the first position and the same conduit of the coil assembly.

The coil frame may further include a first leg having a first side and a second side with a plurality of second notches, and a second leg having a first side and a second side with a plurality of second notches; the accessory tray may include a plurality of tabs; and one of the second notches of the first leg and one of the second notches of the second leg may both engage one of the tabs of the accessory tray.

The electrical switching apparatus accessory may be an under voltage release module; the second ferrous member may be adjacent another one of the tabs of the accessory tray; the coil assembly may further comprise a spring member biasing the ferrous plunger away from the first ferrous member; the another one of the tabs of the accessory tray may include a first edge facing the first ferrous member and a second edge facing the second ferrous member; and the one of the second notches of the first and second legs may both resist a reaction force at the first edge when the circuit energizes the at least one of the number of coils and the ferrous plunger is driven toward the first ferrous member.

The electrical switching apparatus accessory may be a shunt trip module; the coil assembly may further comprise a spring member biasing the ferrous plunger away from the first ferrous member; the one of the tabs of the accessory tray may include a first edge facing the first ferrous member and a second edge facing the second ferrous member; the one of the two second notches of the first and second legs may both resist a reaction force at the first edge when the circuit energizes the at least one of the number of coils and the ferrous plunger is driven toward the first ferrous member; the second ferrous member may be adjacent another one of the tabs of the accessory tray; the another one of the tabs of the accessory tray may include a third edge and a fourth edge opposite the third edge and adjacent the second ferrous member; and the second ferrous member may resist the reaction force at the fourth edge when the circuit energizes the at least one of the number of coils and the ferrous plunger is driven toward the first ferrous member.

As another aspect of the invention, an electrical switching apparatus accessory comprises: an accessory sub-assembly comprising: a coil frame including a first end and a second end opposite the first end, a housing including a plurality of interior surfaces, a first end and a second end opposite the first end of the housing, the second end of the housing having an opening, wherein a number of the interior surfaces of the housing are structured to selectively hold the coil frame in either one of a first position in which the first end of the coil frame faces the first end of the housing and the second end of the coil frame faces the second end of the housing, and a second position in which the first end of the coil frame faces the second end of the housing and the second end of the coil frame faces the first end of the housing; a coil assembly comprising a conduit, a number of coils within the coil frame and being disposed on the conduit, a ferrous plunger movable in the conduit, and a stem coupled to the ferrous plunger; a first ferrous member disposed proximate the first end of the coil frame; a second ferrous member having an opening and being disposed proximate the second end of the coil frame; and a circuit structured to energize at least one of the number of coils, wherein the stem is structured to pass through the opening of the housing, and wherein the stem is structured to engage a trip bar.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The invention is described in association with a circuit breaker including shunt trip and under voltage release accessories, although the invention is applicable to a wide range of any suitable number of accessories and electrical switching apparatus employing the same.

Figure 2:
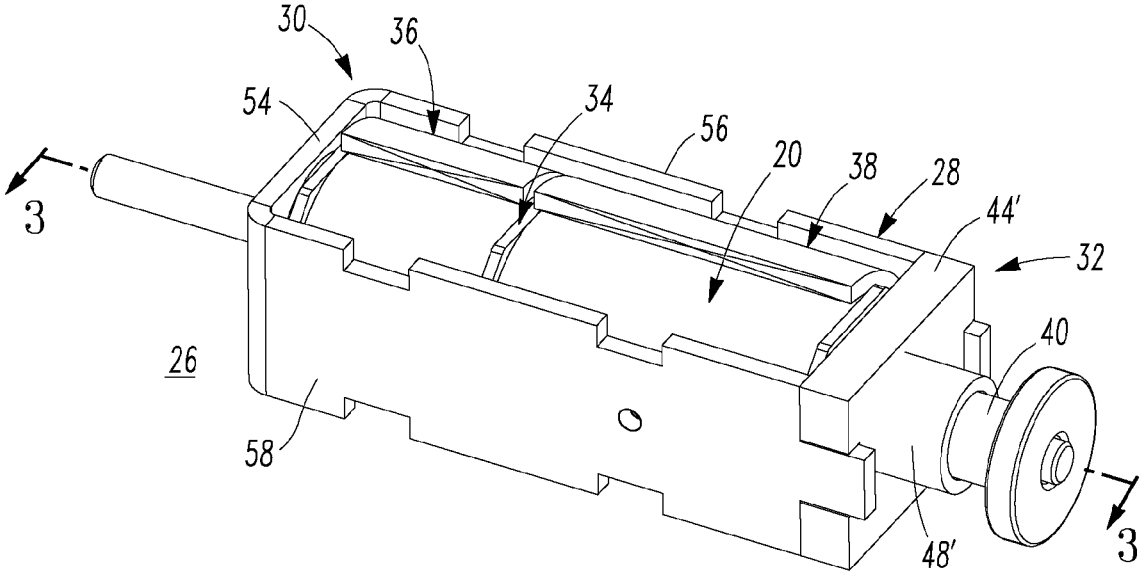
FIG. 2 is an isometric view of a coil assembly for an accessory in accordance with an embodiment of the invention.
Figure 8:
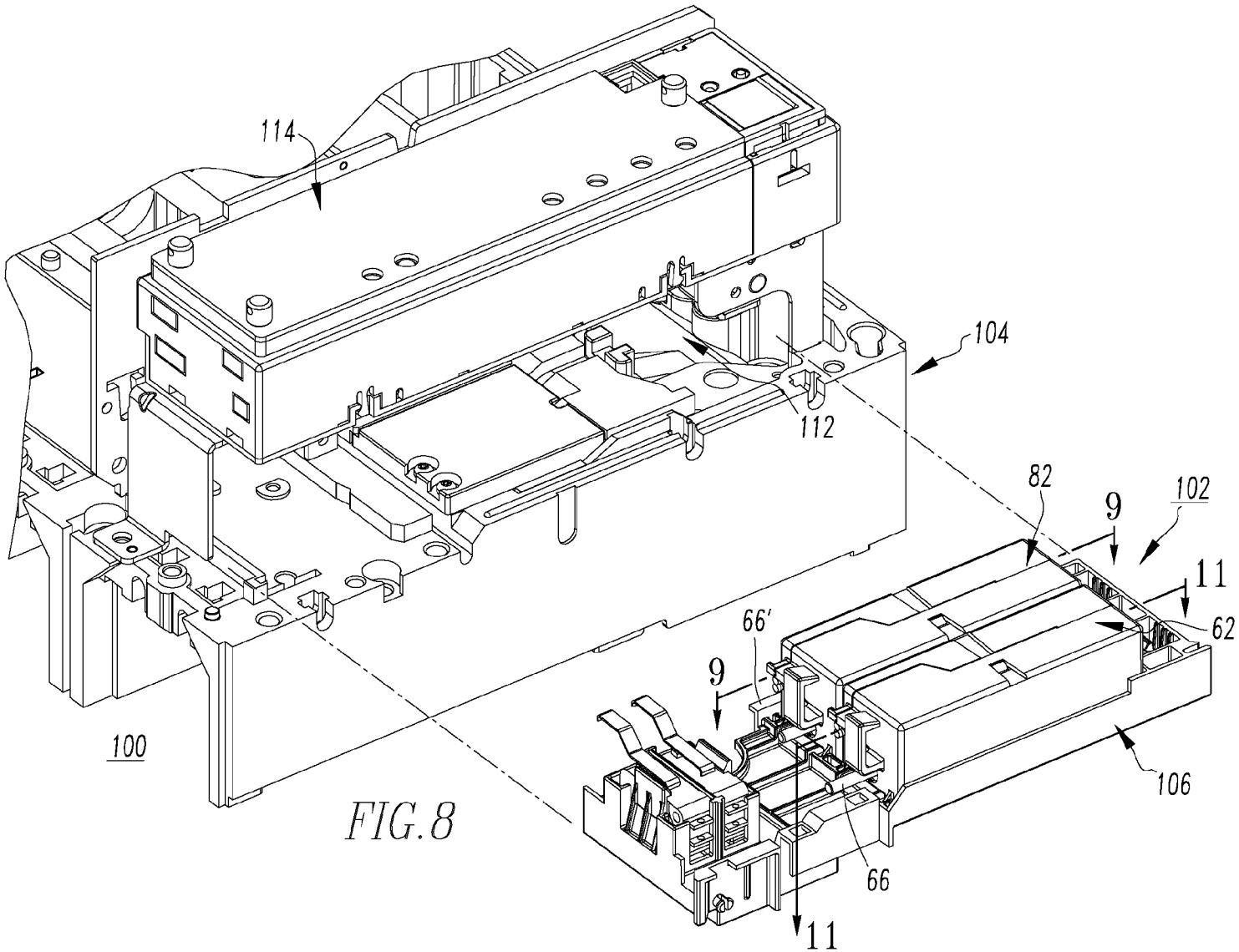
FIG. 8 is an exploded isometric view of the portion of the circuit breaker and the accessory assembly of FIG. 7, modified to show two installed accessories.

FIG. 2 shows a coil assembly 20 for an accessory, such as the example accessories 62,82 shown in FIG. 8. In FIG. 2, an electromagnetic coil apparatus 26 includes a ferrous coil frame 28 having a first end 30 and a second end 32 opposite the first end. The coil assembly 20 includes a conduit 34 (e.g., coil bobbin), a number of coils 36,38 (two coils are shown, although any suitable number of coils may be employed) within the ferrous coil frame 28 and disposed on the conduit 34, and a ferrous plunger 40 movable in the conduit 34.

Figure 3:
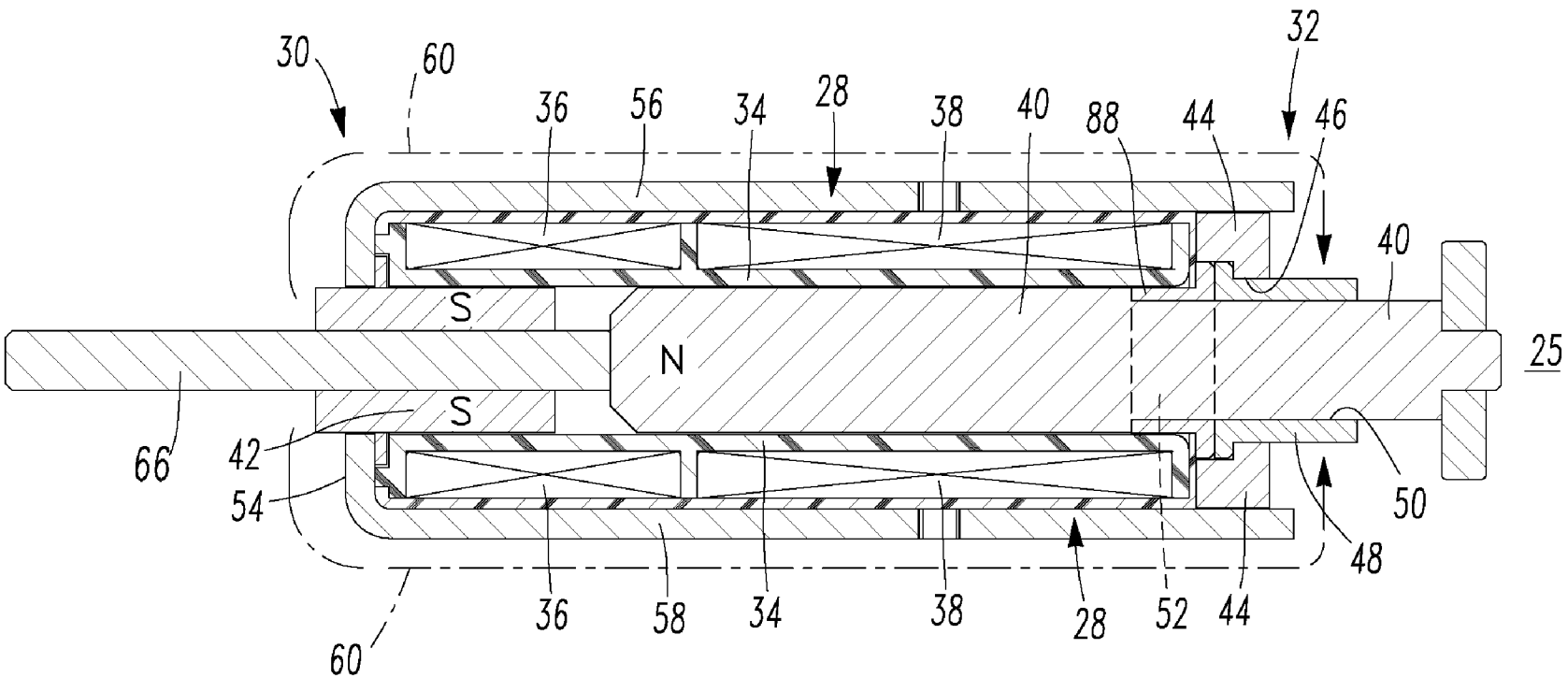
FIG. 3 is a cross-sectional view along lines 3-3 of FIG. 2, except that it is modified to show the ferrous top plate and the magnetic flux enhancer as a two-piece structure in accordance with another embodiment of the invention.
Figure 6:
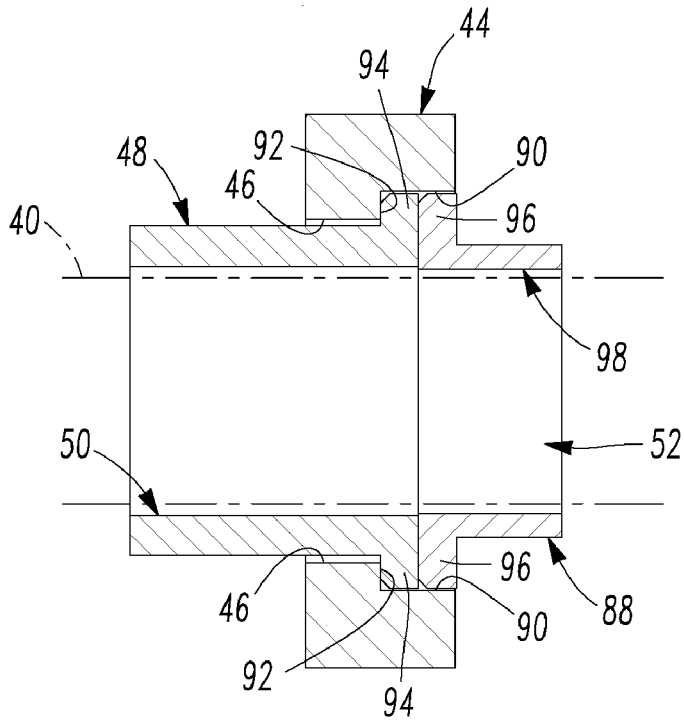
FIG. 6 is an enlarged cross-sectional view of the magnetic flux enhancer and top plate of FIG. 3.

As best shown in FIG. 3, a first ferrous member, such as a ferrous heel 42, is disposed proximate the first end 30 of the ferrous coil frame 28, a second ferrous member, such as a ferrous top plate 44, has an opening 46 and is disposed proximate the second end 32 of the ferrous coil frame 28. A magnetic flux enhancer 48 is external to the conduit 34 and is at least partially external to the ferrous coil frame 28. The magnetic flux enhancer 48 includes a ferrous conduit 50 coupled to the top plate 44 and cooperates with the top plate opening 46 to form a passageway 52 (as best shown in FIG. 6). A portion of the ferrous plunger 40 (shown in phantom line drawing in FIG. 6) passes through the passageway 52 (as best shown in FIG. 6).

In this example, the coils 36,38 include a first pull coil 36 and a second hold coil 38, which is larger than the first pull coil 36. The ferrous coil frame 28 has a general U-shape including a base 54 at the first end 30 and two legs 56,58 extending from the base 54 to the second end 32. The ferrous top plate 44 engages each of the legs 56,58 to form a ferrous loop. Alternatively, as shown in FIG. 2, the ferrous top plate 44' and the magnetic flux enhancer 48' are a single ferrous structure. Regardless, the magnetic flux enhancers 48,48' provide greater surface area at the plunger 40; this provides relatively more flux transfer and, thus, greater force when the respective electromagnetic coil apparatus 25,26 is energized. These apparatus are contrasted to the shunt trip device 2 of FIG. 1, which does not include a magnetic flux enhancer.

Figure 1:
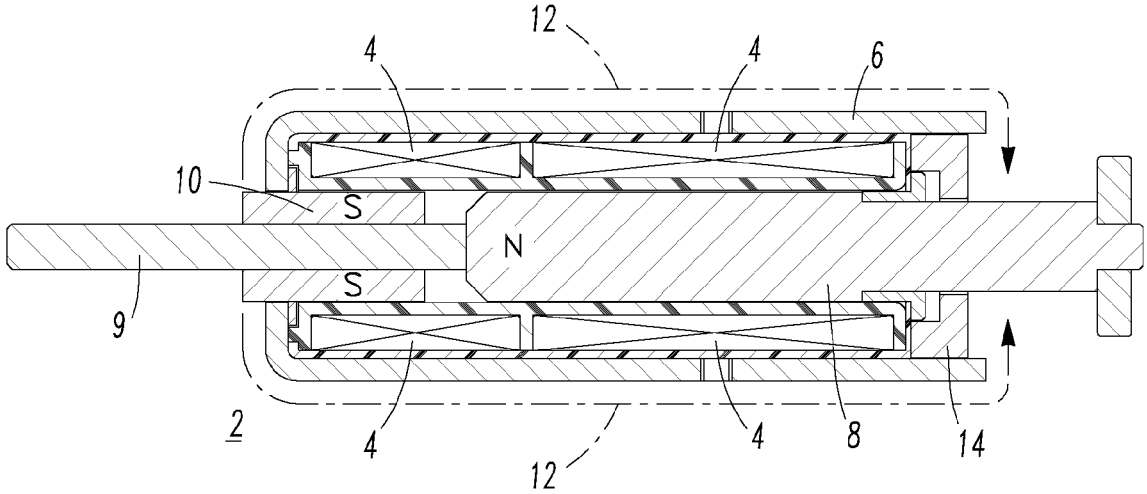
FIG. 1 is a cross-sectional view of a coil assembly for an accessory.

Continuing to refer to FIG. 3, the ferrous coil frame 28, the ferrous heel 42, the ferrous top plate 44, the magnetic flux enhancer 48 and the ferrous plunger 40 cooperate to form a substantially continuous magnetic circuit. When the pull coil 36 is energized with sufficient voltage, current flows through the corresponding coil winding and induces a magnetic field (S/N), as shown. Magnetic flux 60 flows through the ferrous parts that make up the corresponding magnetic circuit. The magnetic flux 60 travels through the coil frame 28 to the top plate 44 and into the magnetic flux enhancer 48. The magnetic flux enhancer 48 increases the surface area between the plunger 40 and the top plate 44 and allows relatively more magnetic flux to "jump" from the magnetic flux enhancer 48 into the plunger 40. This enhanced flow of the magnetic flux 60 causes the plunger 40 to be attracted to the heel 42 with a relatively higher force. In contrast, as shown in FIG. 1, the top plate 14 has a relatively smaller cross-sectional surface area than that of the combined top plate 44 and magnetic flux enhancer 48 of FIG. 3. Since the shunt transfer device 2 of FIG. 1 has relatively less surface area at the top plate 14, this allows for relatively less magnetic flux transfer. Although not shown, the combination of the coil frame 28, the heel 42, the top plate 44 and the magnetic flux enhancer 48 may be one or more components.

The disclosed magnetic flux enhancer 48 of FIG. 3 is disposed external to the conduit 34 and is at least partially external to the ferrous coil frame 28, which allows the diameter of the plunger 40 and the diameter of the coils 36,38 to be as large as possible.

Figure 4:
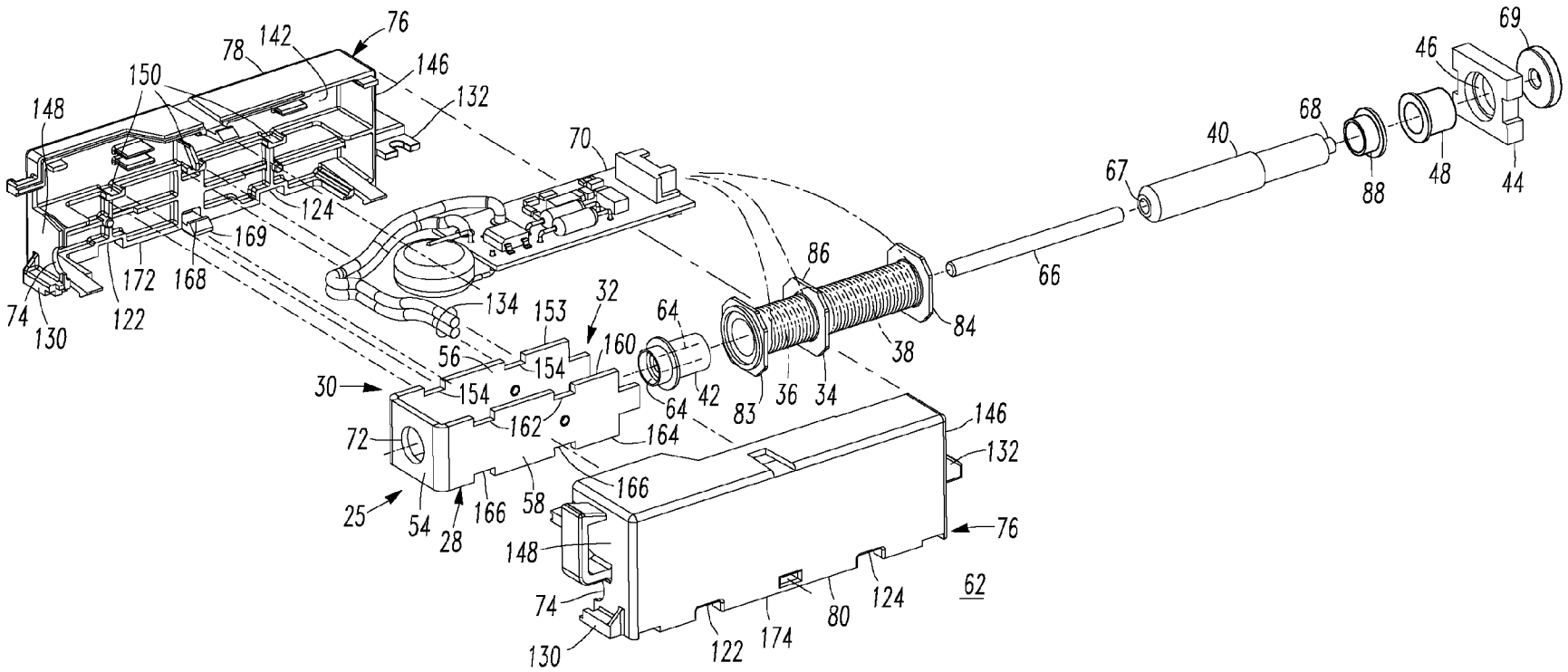
FIG. 4 is an exploded isometric view of a shunt trip module including the coil assembly of FIG. 3 in accordance with another embodiment of the invention.

Referring to FIG. 4, an accessory, such as a shunt trip module 62, includes the electromagnetic coil apparatus 25 of FIG. 3. As shown, the ferrous heel 42 has an opening 64 therethrough. A non-magnetic stem 66, which is suitably coupled to one end 67 of the ferrous plunger 40, passes through the opening 64 of the ferrous heel 42. The other end 68 of the ferrous plunger 40 is coupled to a stop 69.

Figure 5:
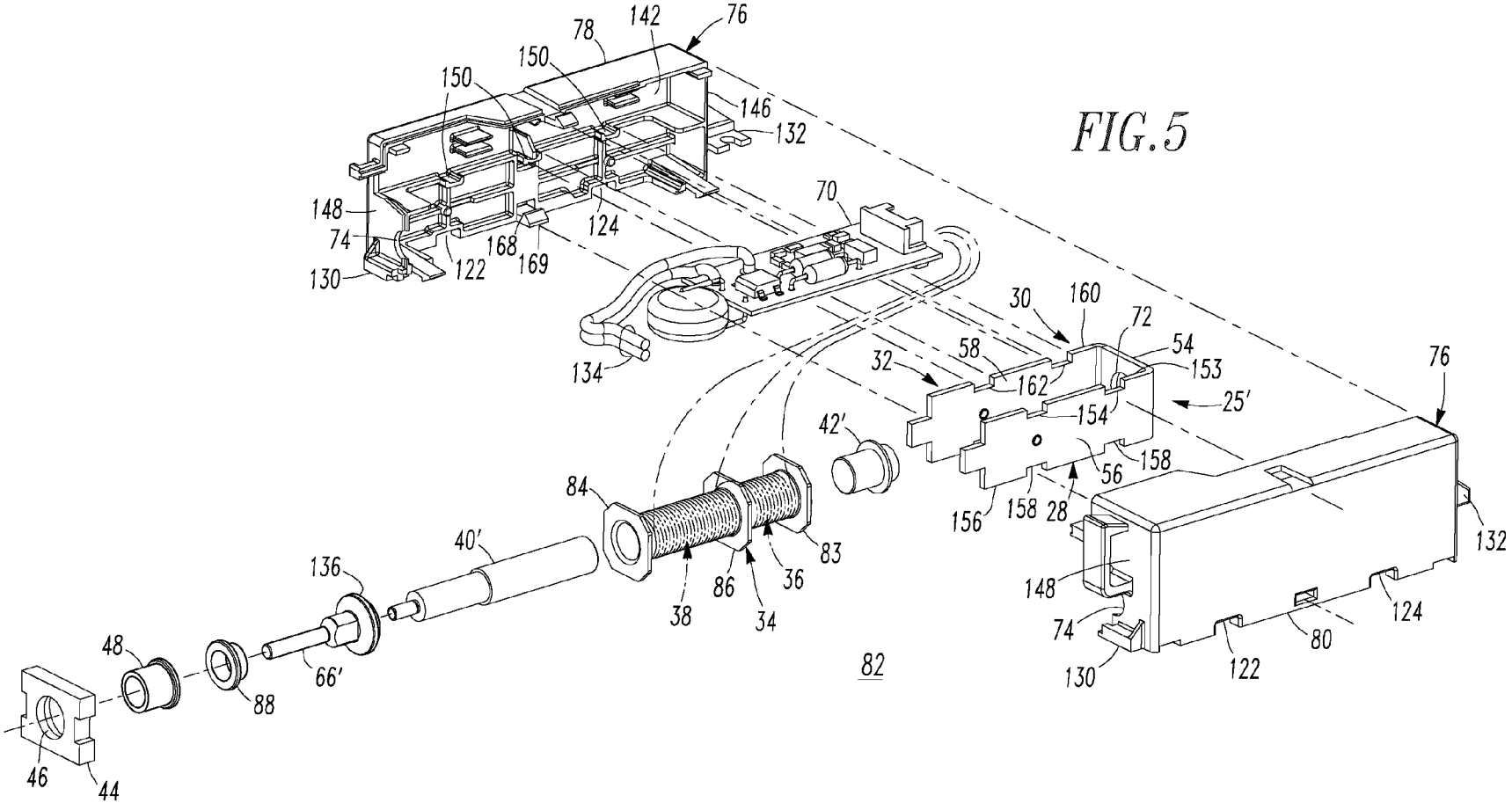
FIG. 5 is an exploded isometric view of an under voltage release module including a coil assembly in accordance with another embodiment of the invention.

A control circuit 70 (e.g., without limitation, a printed circuit board) is suitably structured to drive the coils 36,38 (shown in phantom line drawing). The relatively smaller pull coil 36 (or "trip" coil for the shunt trip module 62), which is energized for a relatively short duration (e.g., without limitation, about 40 to about 50 mS), requires relatively more current than that of the relatively larger hold coil 38, which may be energized for an indefinite period for either of the shunt trip and under voltage release modules 62,82 (FIGS. 4 and 5). When the circuit 70 energizes the pull coil 36 (shown in phantom line drawing), this causes the ferrous plunger 40 to be attracted to the ferrous heel 42. In turn, the non-magnetic stem 66, which passes through an opening 72 in the coil frame base 54, is driven by the ferrous plunger 40 externally through an opening 74 of a housing 76 formed by two housing portions 78,80. The housing 76 holds the circuit 70 and the electromagnetic coil apparatus 25.

FIG. 5 shows an accessory, such as an under voltage release (UVR) module 82, including an electromagnetic coil apparatus 25'. This module 82 is somewhat similar to the module 62 of FIG. 4 and includes many of the same components, such as the ferrous coil frame 28, the conduit 34, the coils 36,38 (shown in phantom line drawing), the ferrous top plate 44, the magnetic flux enhancer 48, the circuit 70, the housing 76 including the housing portions 78,80, and a brass bushing 88 (also shown in FIG. 6). The housing 76 holds the circuit 70 and the electromagnetic coil apparatus 25'. Like the shunt trip module 62, the conduit 34 (e.g., a bobbin) includes a first end member 83, a second end member 84 and a third member 86 intermediate the first and second end members 83,84. The pull coil 36 (shown in phantom line drawing) is disposed on the conduit 34 between the first end member 83 and the third member 86, and the hold coil 38 (shown in phantom line drawing) is disposed on the conduit 34 between the second end member 84 and the third member 86.

Unlike the shunt trip module 62 of FIG. 4, the UVR module 82 includes several different components, such as the ferrous plunger 40', solid ferrous heel 42', and non-magnetic stem 66'. The non-magnetic stem 66' passes through the opening 46 of the ferrous top plate 44. When the circuit 70 energizes the pull coil 36 (shown in phantom line drawing), the ferrous plunger 40' is attracted to the solid ferrous heel 42' and the non-magnetic stem 66' is driven by the ferrous plunger 40' internally through the opening 74 of the housing 76.

Referring to FIG. 6, the magnetic flux enhancer 48 (e.g., made of standard steel; any suitable ferrous steel) and ferrous top plate 44 of FIG. 3 are shown along with a non-magnetic conduit, such as the brass bushing 88. The magnetic flux enhancer 48 is coupled to the top plate 44 and acts as an extension thereof, which extends external to the coil frame 28 (FIG. 3). The magnetic flux enhancer 48 increases the surface area between the ferrous coil plunger 40 (shown in phantom line drawing) (or the ferrous coil plunger 40' of FIG. 5) and the coil frame 28 of FIGS. 4 and 5, and, also, increases the amount of magnetic flux 60 (FIG. 3) transferred into the plungers 40,40'. Since the magnetic flux enhancer 48 is external to the conduit 34 (FIGS. 4 and 5) and extends external to the coil frame 28, this allows the diameter of the plungers 40,40' and the diameter of the coils 36,38 (shown in phantom line drawing in FIGS. 4 and 5) to be as large as possible within the constraints of the corresponding accessories 62,82.

As shown in FIG. 6, the ferrous top plate 44 has a counter-bore 90 forming a rim 92 within the opening 46 thereof. The magnetic flux enhancer 48 has a ferrous collar 94, which engages the rim 92 after being fit within the counter-bore 90. The brass bushing 88 has a collar 96 coupled to the ferrous top plate 44 by also being fit within the counter-bore 90. As shown in FIG. 3, the brass bushing 88 is internal to the coil frame 28 and includes an opening 98 (FIG. 6) that cooperates with the opening 46 of the top plate 44 and the ferrous conduit 50 of the magnetic flux enhancer 48 to form the passageway 52. As shown in FIG. 6, a portion of the ferrous plunger 40 (shown in phantom line drawing) (or the ferrous plunger 40' of FIG. 5) passes through the opening 98, ferrous conduit 50 and passageway 52. In the example of FIG. 6, the ferrous top plate 44 and the magnetic flux enhancer 48 form a two-piece ferrous structure. Alternatively, the brass bushing 88 may be employed with the one-piece ferrous top plate 44' and magnetic flux enhancer 48' of FIG. 2 to form a two-piece structure.

Figure 7:
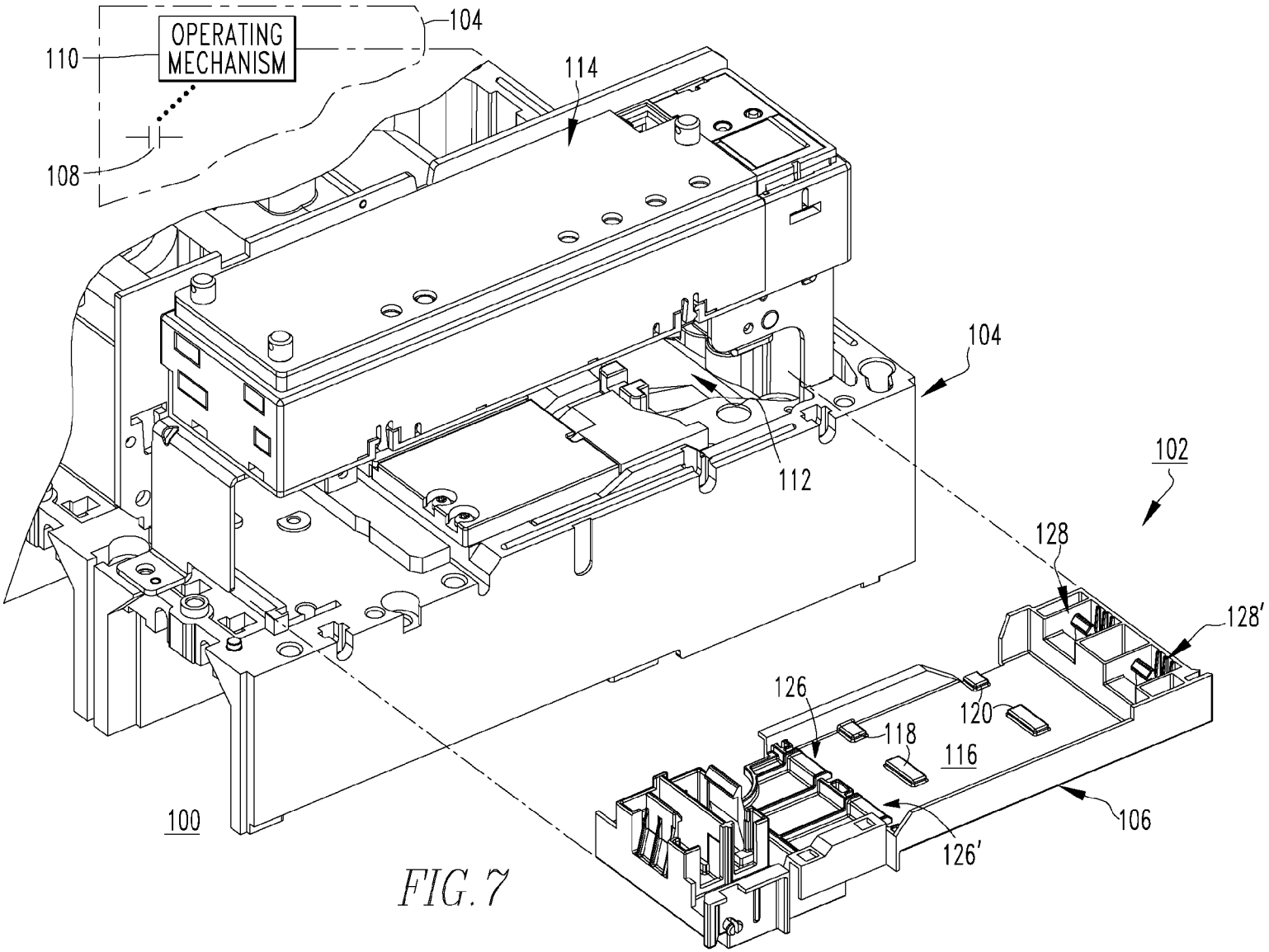
FIG. 7 is an exploded isometric view of a portion of a circuit breaker and an accessory assembly for an accessory in accordance with an embodiment of the invention.
Figure 15:
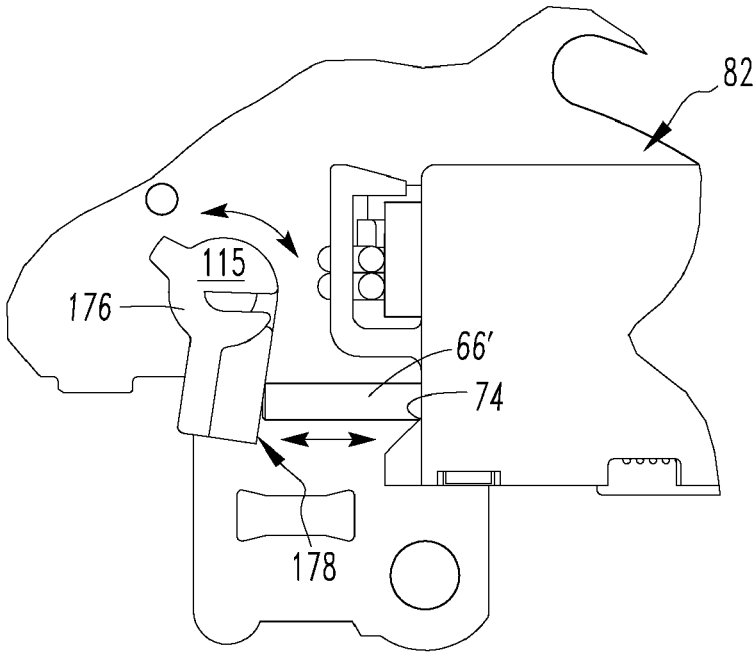
FIG. 15 is a vertical elevation view of the trip bar of the circuit breaker and one of the accessories of FIG. 8.

FIGS. 7 and 8 show an electrical switching apparatus, such as a low-voltage circuit breaker 100, employing an accessory assembly 102. The circuit breaker 100, which is partially shown, includes a housing 104 having an accessory tray 106, separable contacts 108 (shown in simplified form in FIG. 7) enclosed by the housing 104 (partially shown in simplified form in FIG. 7), and an operating mechanism 110 (shown in simplified form in FIG. 7) structured to open and close the separable contacts 108. The accessory assembly 102 is mountable, as shown exploded in FIG. 8, within a housing cavity 112 beneath a trip mechanism 114, and includes at least one accessory, such as the first and second accessories 62,82, shown in FIG. 8, held by the accessory tray 106. The trip mechanism 114, which cooperates with the operating mechanism 110, is structured to trip open the separable contacts 108. The trip mechanism 114 includes a trip bar 115, as shown in FIG. 15. As will be explained, below, in connection with FIG. 15, the non-magnetic stem 66 of the shunt trip module 62 passes through the opening 74 (FIG. 4) of the accessory housing 76 (FIG. 4) and engages the trip bar 115 (FIG. 15) to trip open the separable contacts 108 when the module 62 is energized. Also, the non-magnetic stem 66' of the UVR module 82 passes through the opening 74 (FIG. 5) of the accessory housing 76 and engages the trip bar 115 to trip open the separable contacts 108 when the module 82 is de-energized.

A generally planar intermediate portion 116 of the example accessory tray 106 includes a number of locating tabs 118, 120 (FIG. 7), and the accessories 62,82 (FIGS. 4, 5 and 8) include a number of corresponding recesses 122,124 (FIGS. 4 and 5). Thus, when the accessories 62,82 are installed (FIG. 8) on the intermediate portion 116 (FIG. 7), a corresponding pair of the locating tabs 118,120 is structured to be disposed within the corresponding recesses 122,124, respectively, of the housing 76 of the corresponding accessory 62,82. In this manner, the example accessories 62,82 are aligned and maintained by the coil frame 28 in a predetermined position on the planar intermediate portion 116.

The accessory tray 106 includes first connection mechanisms (e.g., molded receptacles) 126,126' and second connection mechanisms (e.g., resilient tabs) 128,128' disposed on the generally planar intermediate portion 116. The first connection mechanisms 126,126' are each structured to receive and secure one end 130 of the housing 76 of a corresponding one of the accessories 62,82 (FIGS. 4 and 5), and the second connection mechanisms 128,128' are each structured to releasably secure the other end 132 of the accessory housing 76. The accessories 62,82 are installed, for example, in a "toe-heel" fashion, in which the one end 130 is first inserted into the first connection mechanism 126 and is then rotated (e.g., clockwise with respect to FIGS. 7 and 8) until the other end 132 is releasably secured by the second connection mechanism 128. The other connection mechanisms 126', 128' function in a like manner.

In the example circuit breaker 100 of FIGS. 7 and 8, the UVR module 82 (FIGS. 5 and 8-10) and the shunt trip module 62 (FIGS. 4, 8, 11 and 12) are both continuous devices. In other words, the input voltage on the input conductors 134 (FIGS. 4 and 5) to these accessories 62,82 may be applied for an indefinite period of time. Each of these accessories 62,82 includes the "hold" coil 38 and the "pull" coil 36 (FIGS. 4 and 5). The "pull" coil 36 is energized momentarily after the input voltage is applied, and the "hold" coil 38 is energized continuously as long as the input voltage is applied. The printed circuit board (PCB) circuit 70 (FIGS. 4 and 5) controls the switching of the pull and hold coils 36,38.

The same conduit 34, the same coil frame 28 and the same molded housing 76, in addition to the same coils 36,38, ferrous top plate 44, magnetic flux enhancer 48, circuit 70 and brass bushing 88, are preferably employed for both of the shunt trip and UVR modules 62,82. Even though these modules 62,82 perform the opposite function, these common parts are maintained by reversing the coil frame 28 (as shown, for example, in FIGS. 4 and 5) in the corresponding accessory module. Specific mounting features, as will be discussed below in connection with FIGS. 9-12, are employed on either side of the coil frame 28 and the molded housing 76 as well as by the accessory tray 106, in order to accept the coil frame 28 in either of the shunt trip module or UVR module positions.

FIGS. 9-10 and 11-12 respectively show the UVR module 82 and the shunt trip module 62 including, for example, the common coil frame 28, the common conduit 34 and the common molded housing 76. A principal difference between these modules 82,62 is that the common coil frame 28 and, thus, the electromagnetic coil apparatus 25',25, are reversed in each of these accessories. The only other differences between these modules 62,82 are: (1) the plungers 40,40' are different (as best shown in FIGS. 4 and 5); (2) the UVR module 82 employs a flat solid heel 42' while the shunt trip module 62 has an opening 64 in the heel 42 in order to accommodate the plunger stem 66; (3) the UVR stem 66' includes a spring seat 136 (FIG. 5); and (4) different springs 138,138' are employed (as shown in respective FIGS. 11-12 and 9-10). A relatively heavier spring 138' is employed in the UVR module 82 than the spring 138 of the shunt trip module 62, in order to provide the desired tripping force. Also, the flat solid heel 42' of the UVR module 82 is larger than the heel 42 of the shunt trip module 62, in order to overcome the spring force of the relatively heavier spring 138', when the module 82 is energized.

Figure 9:
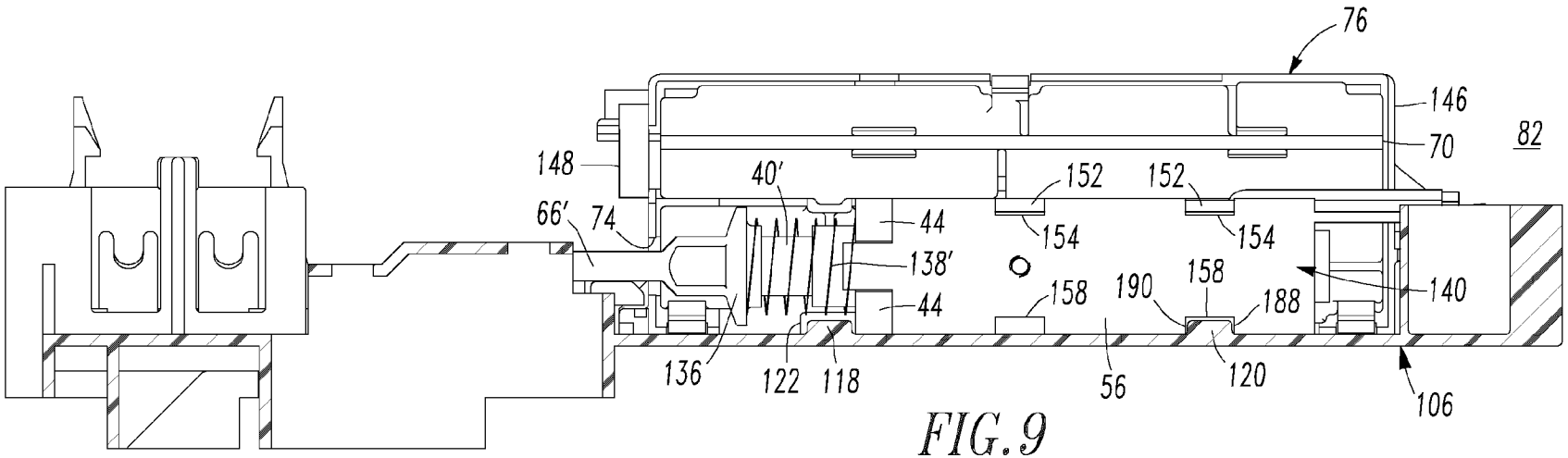
FIG. 9 is a cross sectional view along lines 9-9 of FIG. 8, but with the entire coil assembly being shown.
Figure 10:
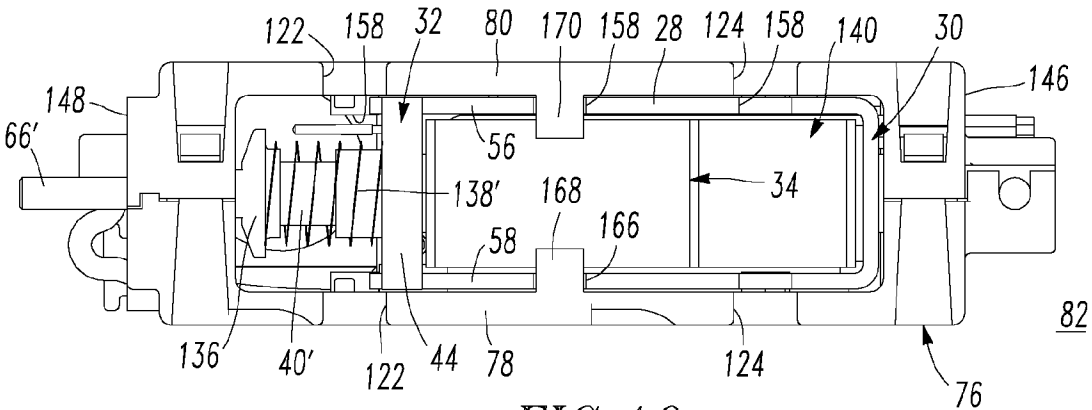
FIG. 10 is a bottom plan view of the under voltage release module of FIG. 9.
Figure 11:
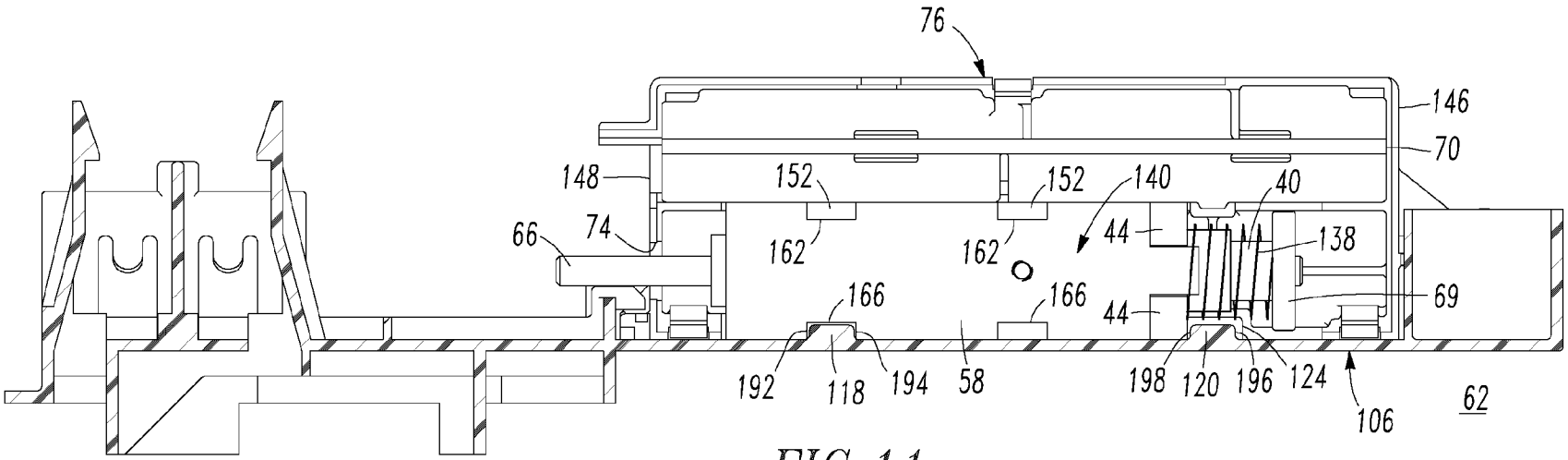
FIG. 11 is a cross sectional view along lines 11-11 of FIG. 8, but with the entire coil assembly being shown.
Figure 12:
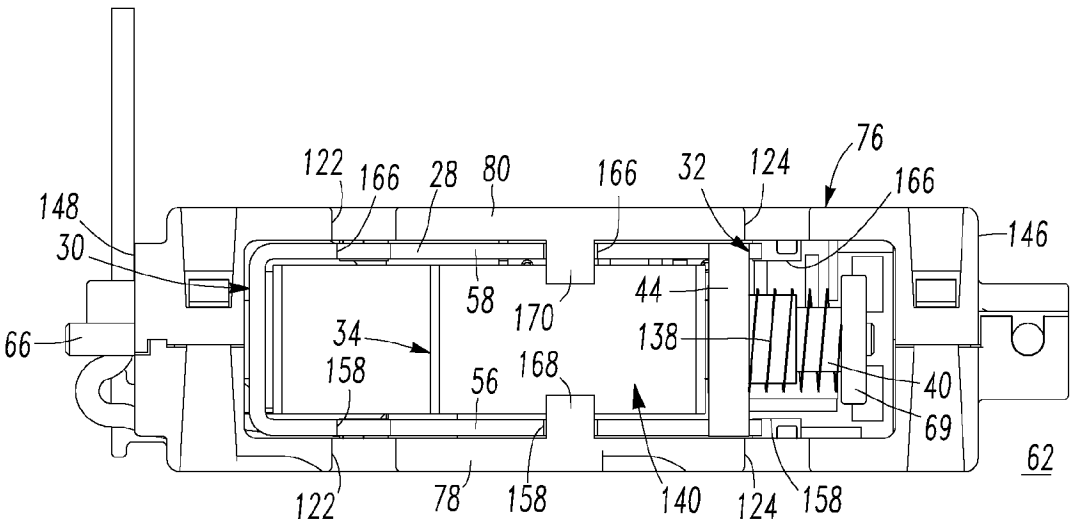
FIG. 12 is a bottom plan view of the shunt trip module of FIG. 11.
Figure 13:
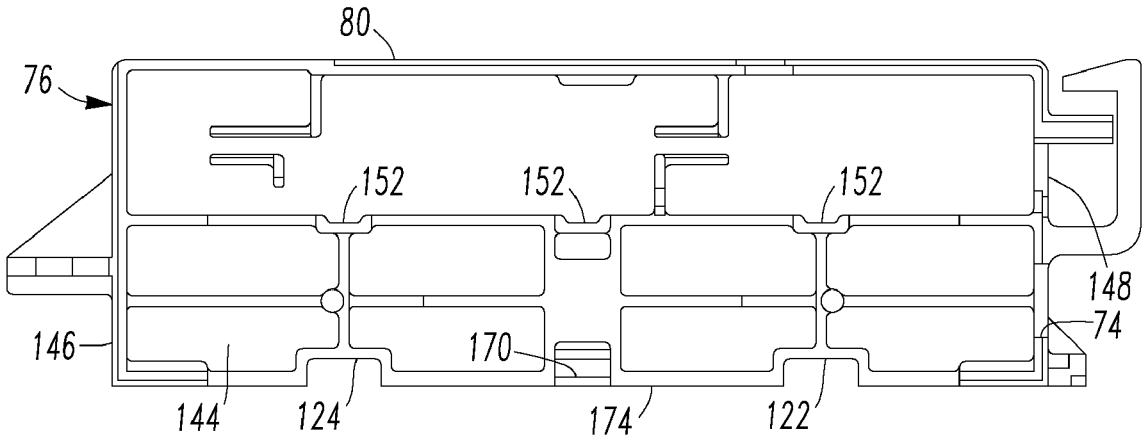
FIG. 13 is an internal vertical elevation view of one of the molded housing sides of FIG. 4.

FIGS. 9, 10 and 13 (UVR module 82), and FIGS. 11-13 (shunt trip module 62) show the mounting features of the coil frame 28, the molded housing portions 78,80 and the accessory tray 106 that allow the coil frame 28 to be reversed.

FIGS. 9 and 10 respectively show a bottom plan view of the UVR module 82 and the module 82 mounted on the accessory tray 106 of FIG. 7. FIGS. 11 and 12 respectively show a bottom plan view of the shunt trip module 62 and the module 62 mounted on the accessory tray 106. As was discussed above in connection with FIGS. 4 and 5, both of the modules 62,82 include an accessory sub-assembly 140 having the coil frame 28 with the first end 30 and the second end 32 opposite the first end 30, and the housing 76. As shown in FIGS. 4, 5 and 13, the housing 76 includes a first interior surface 142 of the first housing portion 78, a second interior surface 144 of the second housing portion 80, a first end 146, and an opposite second end 148 having the opening 74. As will be discussed, the housing interior surfaces 142,144 are structured to selectively hold the coil frame 28 in either one of a first position (FIGS. 9 and 10) in which the coil frame first end 30 faces the housing first end 146 and the coil frame second end 32 faces the housing second end 148, and a second position (FIGS. 11 and 12) in which the coil frame first end 30 faces the housing second end 148 and the coil frame second end 32 faces the housing first end 146.

The first interior surface 142 (FIGS. 4 and 5) includes a plurality of first tabs 150 (e.g., three are shown) and the second interior surface 144 (FIG. 13) includes a plurality of second tabs 152. The coil frame first leg 56 has a first side 153 (FIGS. 4 and 5) with a plurality of first notches 154 (e.g., two are shown) and a second side 156 (FIG. 5) with a number of second notches 158 (e.g., two are shown). The coil frame second leg 58 similarly has a first side 160 (FIGS. 4 and 5) with a plurality of first notches 162 (e.g., two are shown) and a second side 164 (FIG. 4) with a number of second notches 166 (e.g., two are shown).

The coil frame 28 is coupled to the housing 76 as follows. First, as shown in FIG. 4, two of the three first tabs 150 (those two tabs 150 closest to the housing second end 148) of the first interior surface 142 engage the first notches 154 of the first side 153 of the coil frame first leg 56 and two of the three second tabs 152 of the second interior surface 144 (FIG. 13) engage the first notches 162 of the first side 160 of the coil frame second leg 58. Alternatively, as shown in FIG. 5, since the coil frame 28 is reversed with respect to FIG. 4, two of the three first tabs 150 (those two tabs 150 closest to the housing first end 146) of the first interior surface 142 selectively engage the first notches 162 of the first side 160 of the coil frame second leg 58 and two of the three second tabs 152 of the second interior surface 144 (FIG. 13) selectively engage the first notches 154 of the first side 153 of the coil frame first leg 56. Second, as shown in FIGS. 4 and 12, a tab 168 of a locking member 169 (FIG. 4) of the first interior surface 142 engages one of the second notches 158 (shown in FIG. 5) of the second side 156 of the coil frame first leg 56 and a tab 170 of the second interior surface 144 (FIG. 13) engages one of the second notches 166 of the second side 164 of the coil frame second leg 58. Alternatively, as shown in FIGS. 5 and 10, since the coil frame 28 is reversed with respect to FIG. 4, the tab 168 of the locking member 169 (FIG. 5) of the first interior surface 142 selectively engages one of the second notches 166 of the second side 164 of the coil frame second leg 58 (shown in FIG. 4) and the tab 170 of the second interior surface 144 (FIG. 13) selectively engages one of the second notches 158 of the second side 156 of the coil frame first leg 56.

After the two housing portions 78,80 are coupled, the housing 76 and the coil frame 28 are then mounted on the accessory tray 106 as follows. The housing first interior surface 142 includes a first edge 172 having the two recesses 122,124, which are larger than the notches 158,166 of the coil frame 28. Also, the housing second interior surface 144 includes a second edge 174 having the recesses 122,124, which are larger than the notches 158,166 of the coil frame 28 (as is best shown at the top of FIG. 10 with the relatively larger recesses 122,124 and the relatively smaller notches 158, and at the top of FIG. 12 with the relatively larger recesses 122,124 and the relatively smaller notches 166). The two notches 122,124 of the first and second edges 172,174 are structured to overlay, but not engage, the tabs 118,120 of the accessory tray 106 (as best shown with the recess 122 and tab 118 of FIG. 9 and with the recess 124 and tab 120 of FIG. 11). Of import, one of the second notches 158 of the coil frame first leg 56 and one of the second notches 166 of the coil frame second leg 58 both engage the tab 120 of the accessory tray 106 as shown in FIG. 9. Similarly, as shown in FIG. 11, one of the second notches 166 of the coil frame second leg 58 and one of the second notches 158 of the coil frame first leg 56 both engage the tab 118 of the accessory tray 106.

Operation of the UVR module 82 of FIGS. 5, 9, 10 and 15 is as follows. The trip bar 115 (FIG. 15) of the trip mechanism 114 (FIG. 7) is structured to pivot to trip open the separable contacts 108 (FIG. 7) in a well known manner. The spring 138' of FIGS. 9 and 10, which is disposed between the ferrous top plate 44 and the spring seat 136, biases the ferrous plunger 40' away from the ferrous heel 42' (FIG. 5). After the circuit 70 energizes the pull coil 36 (FIG. 5), the ferrous plunger 40' is attracted to the ferrous heel 42'. Then, the circuit 70 energizes the hold coil 38 (FIG. 5) and de-energizes the pull coil 36. This maintains the UVR module 82 in its normal, non-tripped state in which a sufficient voltage is present at the conductors 134 (FIG. 5) and the non-magnetic stem 66' is retracted. In this state, the hold coil 38 is structured to be continuously energized. Then, in response to an insufficient voltage being present at the conductors 134, the circuit 70 de-energizes the hold coil 38 and the ferrous plunger 40' is driven by the spring 138' away from the ferrous heel 42'. In turn, the non-magnetic stem 66' is driven by the ferrous plunger 40' externally through the housing opening 74 to engage and pivot (clockwise with respect to FIG. 15) the trip bar 115 in order to trip open the separable contacts 108. It will be appreciated that the trip bar 115 is responsive to the extension of the non-magnetic stem 66 of the shunt trip module 62 in a like manner.

Operation of the shunt trip module 62 of FIGS. 4, 11 and 12 is as follows. The spring 138, which is disposed between the ferrous top plate 44 and the stop 69, biases the ferrous plunger 40 away from the ferrous heel 42 (FIG. 4). This maintains the shunt trip module 62 in its normal, non-tripped state in which no voltage is present at the conductors 134 (FIG. 4) and the non-magnetic stem 66 is retracted. Here, both of the coils 36,38 are normally de-energized. In response to sufficient voltage being present at the conductors 134, the circuit 70 energizes the pull coil 36, and the ferrous plunger 40 is attracted to the ferrous heel 42. This causes the non-magnetic stem 66 to be driven by the ferrous plunger 40 externally through the housing opening 74 to engage and pivot the trip bar 115 (as was discussed above in connection with FIG. 15 with the stem 66' of the UVR module 82) to trip open the separable contacts 108. Then, the circuit 70 energizes the hold coil 38 and de-energizes the pull coil 36. This maintains the shunt trip module 82 in its tripped state in which a sufficient voltage is present at the conductors 134 and the non-magnetic stem 66 is extended. Here, again, the hold coil 38 is structured to be continuously energized for an indefinite period of time.

Figure 14:
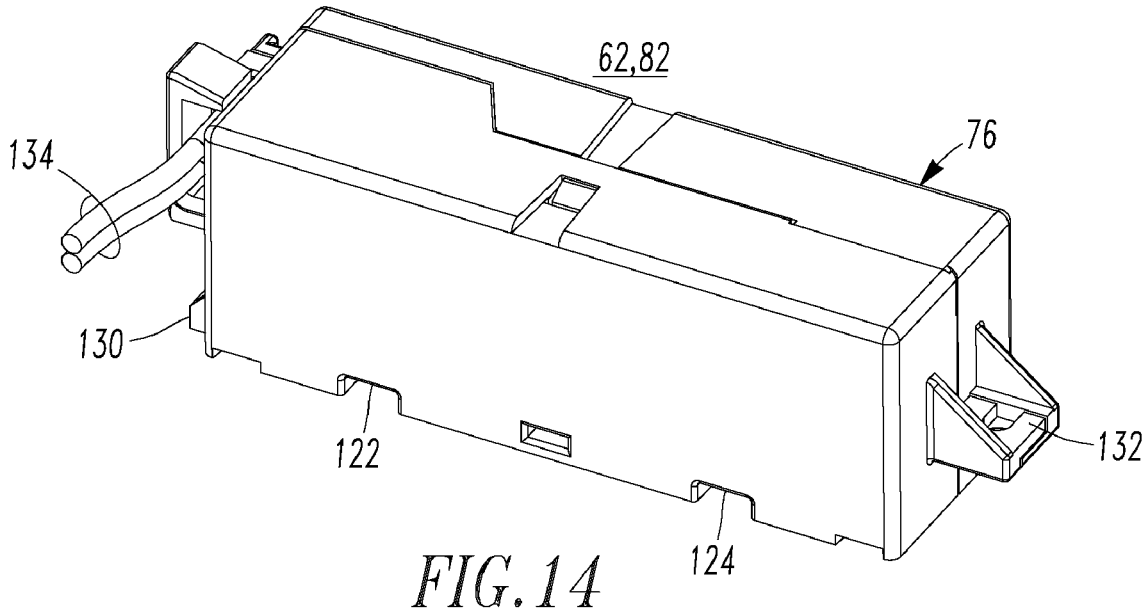
FIG. 14 is an isometric view of an accessory module in accordance with embodiments of the invention.

FIG. 14 shows the assembled housing 76 of the accessories 62,82.

Referring to FIG. 15, the trip bar 115 of the circuit breaker 100 (FIGS. 7 and 8) includes an elongated pivot member 176, which is pivotably coupled to the circuit breaker operating mechanism 110 (shown in simplified form in FIG. 7). The trip bar 115 includes at least one protrusion such as, for example and without limitation, a number of auxiliary paddles 178 (one auxiliary paddle 178 is shown), which extend outwardly from the trip bar 115. The auxiliary paddle 178 is structured to be actuated by one or both of the stems 66,66' of the respective accessories 62,82 (as shown with the stem 66' and accessory 82 of FIG. 15 when the stem 66' extends in response to a trip condition as determined by the accessory 82). Each stem 66,66' is movable between a retracted position, not shown, in which the stem 66,66' does not actuate the auxiliary paddle 178, and an extended position (FIG. 15), in which the stem 66,66' actuates (e.g., moves) the auxiliary paddle 178 and thereby pivots (e.g., clockwise with respect to FIG. 15) the trip bar 115.

Continuing to refer to FIG. 15, the example trip bar 115 further includes a tab 180, which extends outwardly therefrom and is biased by a resilient element (e.g., without limitation, spring) (not shown) of the circuit breaker 100. This resilient element biases the tab 180 of the elongated pivot member 176, thereby biasing (e.g., counterclockwise with respect to FIG. 15) the trip bar 115 and the elongated auxiliary paddle 178 thereof, toward engagement with the stem 66'. In this manner, the resilient element biases the trip bar 115 into a position in which it is ready to be actuated by the accessory stems 66,66', for example, in response to a trip condition of the circuit breaker 2.

In the UVR module 82 of FIG. 9, the ferrous top plate 44 is adjacent the tab 118 of the accessory tray 106. The other tab 120 of the accessory tray 106 includes a first edge 188 facing the ferrous heel 42' (FIG. 5) and a second edge 190 facing the ferrous top plate 44. One or both of the second notches 158, 166 (e.g., as shown with the notch 158 toward the right side of FIG. 9) of the first and second coil frame legs 56,58 resists a reaction force (e.g., toward the left of FIG. 9) at the first edge 188 when the circuit 70 energizes the pull coil 36 (FIG. 5) and the ferrous plunger 40' is driven toward (e.g., toward the right in FIG. 9) the ferrous heel 42'.

In the shunt trip module 62 of FIG. 11, the tab 118 of the accessory tray 106 includes a first edge 192 facing the ferrous heel 42 (FIG. 4) and a second edge 194 facing the ferrous top plate 44. One or both of the two second notches 166,158 (e.g., as shown with the notch 166 toward the left side of FIG. 11) of the first and second coil frame legs 56,58 resists a reaction force (e.g., toward the right of FIG. 9) at the first edge 192 when the circuit 70 energizes the pull coil 36 (FIG. 4) and the ferrous plunger 40 is driven toward (e.g., toward the left of FIG. 11) the ferrous heel 42. The ferrous top plate 44 is adjacent the other tab 120 of the accessory tray 106. That tab 120 includes a third edge 196 and an opposite fourth edge 198 adjacent the ferrous top plate 44. The ferrous top plate 44 resists the reaction force (e.g., toward the right of FIG. 9) at the fourth edge 198 when the circuit 70 energizes the pull coil 36 and the ferrous plunger 40 is driven toward the ferrous heel 42.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An electrical switching apparatus accessory sub-assembly for an electromagnetic coil including a movable stem said electrical switching apparatus accessory sub-assembly comprising:

a coil frame including a first end and a second end opposite said first end;

a housing including a plurality of interior surfaces, a first end and a second end opposite the first end of said housing, the second end of said housing having an opening structured to receive the movable stem of said electromagnetic coil;

wherein a number of the interior surfaces of said housing are structured to selectively hold said coil frame in either one of a first position in which the first end of said coil frame faces the first end of said housing and the second end of said coil frame faces the second end of said housing, and a second position in which the first end of said coil frame faces the second end of said housing and the second end of said coil frame faces the first end of said housing; and wherein the interior surfaces of said housing are a first interior surface including a plurality of first tabs and a second interior surface including a plurality of second tabs; wherein said coil frame further includes a first leg having a first side with a plurality of first notches and a second side with a number of second notches, and a second leg having a first side with a plurality of first notches and a second side with a number of second notches; wherein some of the first tabs of said first interior surface are structured to engage the first notches of the first side of said first leg and some of the second tabs of said second interior surface are structured to engage the first notches of the first side of said second leg in said second position; wherein some of the first tabs of said first interior surface are structured to engage the first notches of the first side of said second leg and some of the second tabs of said second interior surface are structured to engage the first notches of the first side of said first leg in said first position; wherein one of the first tabs of said first interior surface is structured to engage one of said number of second notches of the second side of said first leg and one of the second tabs of said second interior surface is structured to engage one of said number of second notches of the second side of said second leg in said second position; and wherein one of the first tabs of said first interior surface is structured to engage one of said number of second notches of the second side of said second leg and one of the second tabs of said second interior surface is structured to engage one of said number of second notches of the second side of said first leg in said first position.

2. The electrical switching apparatus accessory sub-assembly of claim 1 wherein said number of second notches of said first leg is two second notches and said number of second notches of said second leg is two second notches; and wherein one of said two second notches of said first leg and one of said two second notches of said second leg are both structured to engage one of a number of tabs of an accessory tray.

3. The electrical switching apparatus accessory sub-assembly of claim 2 wherein the first interior surface of said housing includes a first edge having two first recesses, which are larger than the two second notches of said first and second legs; wherein the second interior surface of said housing includes a second edge having two second recesses, which are larger than the two second notches of said first and second legs; wherein the two first recesses of the first edge are structured to overlay two of said number of tabs of an accessory tray; and wherein the two second recesses of the second edge are structured to overlay two of said number of tabs of an accessory tray.

4. The electrical switching apparatus accessory sub-assembly of claim 2 wherein said coil frame has a general U-shape including a base and said first and second legs extending from said base.

5. The electrical switching apparatus accessory sub-assembly of claim 4 wherein said base is structured to hold a first ferrous member; and wherein said first and second legs include first and second ends, respectively, which are structured to hold a second ferrous member having an opening structured to receive said movable stem.

6. An electrical switching apparatus comprising:

separable contacts;

an operating mechanism structured to open and close said separable conacts;

a trip mechanism structured to trip open said separable contacts, said trip mechanism including a trip bar;

an enclosure enclosing said separable contacts; and an electrical switching apparatus accessory comprising:

an accessory sub-assembly comprising:

a coil frame including a first end and a second end opposite said first end;

a housing including a plurality of interior surfaces, a first end and a second end opposite the first end of said housing, the second end of said housing having an opening;

wherein a number of the interior surfaces of said housing are structured to selectively hold said coil frame in either one of a first position in which the first end of said coil frame faces the first end of said housing and the second end of said coil frame faces the second end of said housing, and a second position in which the first end of said coil frame faces the second end of said housing and the second end of said coil frame faces the first end of said housing;

a coil assembly comprising a conduit, a number of coils within said coil flame and being disposed on said conduit, a ferrous plunger movable in said conduit, and a stem coupled to said ferrous plunger;

a first ferrous member disposed proximate the first end of said coil frame;

a second ferrous member having an opening and being disposed proximate the second end of said coil flame;

a circuit structured to energize at least one of said number of coils, wherein said stein is structured to pass through the opening of said housing;

wherein said stem is structured to engage said trip bar to trip open said separable contacts; and wherein said electrical switching apparatus accessory is a shunt trip module; wherein said trip bar is structured to pivot to trip open said separable contacts; wherein said first ferrous member is a ferrous heel having an opening therethrough; wherein said second ferrous member is a ferrous top plate; wherein said stem is a non-magnetic stem; wherein said non-magnetic stem passes through the opening of said ferrous heel; wherein said coil assembly further comprises a spring member biasing said ferrous plunger away from said ferrous heel; and wherein when said circuit energizes said at least one of said number of coils, said ferrous plunger is attracted toward said ferrous heel and said non-magnetic stein is driven by said ferrous plunger externally through the opening of said housing to engage and pivot said trip bar to trip open said separable contacts.

7. An electrical switching apparatus comprising:

separable contacts;

an operating mechanism structured to open and close said separable contacts;

a trip mechanism structured to trip open said separable contacts, said trip mechanism including a trip bar;

an enclosure enclosing said separable contacts; and an electrical switching apparatus accessory comprising:

an accessory sub-assembly comprising:

a coil frame including a first end and a second end opposite said first end;

a housing including a plurality of interior surfaces, a first end and a second end opposite the first end of said housing, the second end of said housing having an opening;

wherein a number of the interior surfaces of said housing are structured to selectively hold said coil frame in either one of a first position in which the first end of said coil frame faces the first end of said housing and the second end of said coil frame faces the second end of said housing, and a second position in which the first end of said coil frame faces the second end of said housing and the second end of said coil frame faces the first end of said housing;

a coil assembly comprising a conduit, a number of coils within said coil frame and being disposed on said conduit, a ferrous plunger movable in said conduit, and a stem coupled to said ferrous plunger;

a first ferrous member disposed proximate the first end of said coil frame;

a second ferrous member having an opening and being disposed proximate the second end of said coil frame;

a circuit structured to energize at least one of said number of coils, wherein said stem is structured to pass through the opening of said housing;

wherein said stem is structured to engage said trip bar to trip open said separable contacts; and wherein said electrical switching apparatus accessory is an under voltage release module; wherein said trip bar is structured to pivot to trip open said separable contacts; wherein said first ferrous member is a ferrous heel; wherein said second ferrous member is a ferrous top plate; wherein said stem is anon-magnetic stem; wherein said non-magnetic stem passes through the opening of said ferrous top plate; wherein said coil assembly further comprises a spring member biasing said ferrous plunger away from said ferrous heel; and wherein when said circuit de-energizes said at least one of said number of coils, said ferrous plunger is driven by said spring member away from said ferrous heel and said non-magnetic stem is driven by said ferrous plunger externally through the opening of said housing to engage and pivot said trip bar to trip open said separable contacts.

8. An electrical switching apparatus comprising:

separable contacts;

an operating mechanism structured to open and close said separable contacts;

a trip mechanism structured to trip open said separable contacts, said trip mechanism including a trip bar;

an enclosure enclosing said separable contacts; and an electrical switching apparatus accessory comprising:

an accessory sub-assembly comprising:

a coil frame including a first end and a second end opposite said first end;

a housing including a plurality of interior surfaces, a first end and a second end opposite the first end of said housing, the second end of said housing having an opening;

wherein a number of the interior surfaces of said housing are structured to selectively hold said coil frame in either one of a first position in which the first end of said coil frame faces the first end of said housing end the second end of said coil frame faces the second end of said housing, and a second position in which the first end of said coil frame faces the second end of said housing and the second end of said coil frame faces the first end of said housing;

a coil assembly comprising a conduit, a number of coils within said coil frame and being disposed on said conduit, a ferrous plunger movable in said conduit, and a stem coupled to said ferrous plunger;

a first ferrous member disposed proximate die first end of said coil frame;

a second ferrous member having an opening and being disposed proximate the second end of said coil frame;

a circuit structured to energize at least one of said number of coils, wherein said stein is structured to pass through the opening of said housing;

wherein said stem is structured to engage said trip bar to trip open said separable contacts; and wherein said second ferrous member further has a magnetic flux enhancer external to said conduit and being at least partially external to said coil frame, said magnetic flux enhancer comprising a ferrous conduit coupled to said second ferrous member, said magnetic flux enhancer cooperating with the opening of said second ferrous member to form a passageway; and wherein a portion of the ferrous plunger of said coil assembly passes through said passageway.

9. An electrical switching apparatus comprising:

separable contacts;

an operating mechanism structured to open and close said separable contacts;

a trip mechanism structured to trip open said separable contacts, said trip mechanism including a trip bar;

an enclosure enclosing said separable contacts; and an electrical switching apparatus accessory comprising:

an accessory sub-assembly comprising:

a coil frame including a first end and a second end opposite said first end;

a housing including a plurality of interior surfaces, a first end arid a second end opposite the first end of said housing, the second end of said housing having an opening;

wherein a number of the interior surfaces of said housing are structured to selectively hold said coil frame in either one of a first position in which the first end of said coil frame faces the first end of said housing and she second end of said coil frame faces the second end of said housing, and a second position in which the first end of said coil frame faces the second end of said housing and the second end of said coil flame faces the first end of said housing;

a coil assembly comprising a conduit, a number of coils within said coil frame and being disposed on said conduit, a ferrous plunger movable in said conduit and a stem coupled to said ferrous plunger;

a first ferrous member disposed proximate the first end of said coil frame;

a second ferrous member having an opening and being disposed proximate the second end of said coil frame;

circuit structured to energize at least one of said number of coils, wherein said stem is structured to pass through the opening of said housing;

wherein said stern is structured to engage said trip bar to trip open said separable contacts; and wherein said coil frame has a general U-shape including a base and first and second legs extending from said base; and wherein said base is structured to hold said first ferrous member; and wherein said first and second legs include first and second ends, respectively, which are structured to hold said second ferrous member.

10. An electrical switching apparatus comprising:

separable contacts;

an operating mechanism structured, to open and close said separable contacts;

a trip mechanism structured to trip open said separable contacts, said trip mechanism including a trip bar;

an enclosure enclosing said separable contacts; and an electrical switching apparatus accessory comprising:

an accessory sub-assembly comprising:

a coil frame including a first end and a second end opposite said first end;

a housing including a plurality of interior surfaces, a first end and a second end opposite the first end of said housing, the second end of said housing having an opening;

wherein a number of the interior surfaces of said housing are structured to selectively hold said coil frame in either one of a first position in which the first end of said coil frame faces the first end of said housing and the second end of said coil frame faces the second end of said housing, and a second position in which the first end of said coil frame faces the second end of said housing and the second end of said coil frame faces the first end of said housing;

a coil assembly comprising a conduit, a number of coils within said coil frame and being disposed on said conduit, a ferrous plunger movable in said conduit, and a stem coupled to said ferrous plunger;

a first ferrous member disposed proximate the first end of said coil frame;

a second ferrous member having an opening and being disposed proximate the second end of said coil frame;

a circuit structured to energize at least one of said number of coils, wherein said stem is structured to pass through the opening of said housing;

wherein said stem is structured to engage said trip bar to trip open said separable contacts;

wherein said enclosure includes an accessory tray holding a number of electrical switching apparatus accessories including said electrical switching apparatus accessory; and wherein said coil frame further includes a first leg having a first side and a second side with a plurality of second notches, and a second leg having a first side and a second side with a plurality of second notches; wherein said accessory tray includes a plurality of tabs; and wherein one of said second notches of said first leg and one of said second notches of said second leg both engage one of said tabs of said accessory tray.

11. The electrical switching apparatus of claim 10 wherein said electrical switching apparatus accessory is an under voltage release module; wherein said second ferrous member is adjacent another one of said tabs of said accessory tray; wherein said coil assembly further comprises a spring member biasing said ferrous plunger away from said first ferrous member; wherein said another one of said tabs of said accessory fray includes a first edge facing said first ferrous member and a second edge facing said second ferrous member; and wherein said one of said second notches of said first and second legs both resist a reaction force at said first edge when said circuit energizes said at least one of said number of coils and said ferrous plunger is driven toward said first ferrous member;

12. The electrical switching apparatus of claim 10 wherein said electrical switching apparatus accessory is a shunt trip module; wherein said coil assembly further comprises a spring member biasing said ferrous plunger away from said first ferrous member; wherein said one of said tabs of said accessory tray includes a first edge facing said first ferrous member and a second edge facing said second ferrous member; wherein said one of said two second notches of said first and second legs both resist a reaction force at said first edge when said circuit energizes said at least one of said number of coils and said ferrous plunger is driven toward said first ferrous member; wherein said second ferrous member is adjacent another one of said tabs of said accessory tray; wherein said another one of said tabs of said accessory tray includes a third edge and a fourth edge opposite said third edge and adjacent said second ferrous member; and wherein said second ferrous member resists said reaction force at said fourth edge when said circuit energizes said at least one of said number of coils and said ferrous plunger is driven toward said first ferrous member.

13. The electrical switching apparatus of claim 10 wherein said number of coils is a plurality of coils, which are normally de-energized; and wherein one of said coils is structured to be continuously energized.

14. The electrical switching apparatus of claim 10 wherein said number of coils is a plurality of coils; and wherein one of said coils is structured to be normally continuously energized.

15. An electrical switching apparatus comprising:

separable contacts;

an operating mechanism structured to open and close said separable contacts;

a trip mechanism structured to trip open said separable contacts, said trip mechanism including a trip bar;

an enclosure enclosing said separable contacts; and an electrical switching apparatus accessory comprising:

an accessory sub-assembly comprising:

a coil frame including a first end and a second end opposite said first end;

a housing including a plurality of interior surfaces, a first end and a second end opposite the first end of said housing, the second end of said housing having an opening;

wherein a number of the interior surfaces of said housing are structured to selectively hold said coil frame in either one of a first position in which the first end of said coil frame faces the first end of said housing and the second end of said coil frame faces the second end of said housing, and a second position in which the first end of said coil frame faces the second end of said housing and the second end of said coil frame faces the first end of said housing;

a coil assembly comprising a conduit, a number of coils within said coil frame and being disposed on said conduit, a ferrous plunger movable in said conduit, and a stem coupled to said ferrous plunger;

a first ferrous member disposed proximate the first end of said coil frame;

a second ferrous member having an opening and being disposed proximate the second end of said coil frame;

a circuit structured to energize at least one of said number of coils, wherein said stem is structured to pass though the opening of said housing;

wherein said stem is structured to engage said trip bar to trip open said separable contacts; and wherein the interior surfaces of said housing are a first interior surface including a plurality of first tabs and a second interior surface including a plurality of second tabs; wherein said coil frame further includes a first leg having a first side with a plurality of first notches and a second side with a number of second notches, and a second leg having a first side with a plurality of first notches and a second side with a number of second notches; wherein some of the first tabs of said first interior surface selectively engage the first notches of the first side of said first leg and some of the second tabs of said second interior surface selectively engage the first notches of the first side of said second leg in said second position; wherein some of the first tabs of said first interior surface selectively engage the first notches of the first side of said second leg and some of the second tabs of said second interior surface selectively engage the first notches of the first side of said first leg in said first position; wherein one of the first tabs of said first interior surface selectively engages one of said number of second notches of the second side of said first leg and one of the second tabs of said second interior surface selectively engages one of said number of second notches of the second side of said second leg in said second position; and wherein one of the first tabs of said first interior surface selectively engages one of said number of second notches of the second side of said second leg and one of the second tabs of said second interior surface selectively engages one of said number of second notches of the second side of said first leg in said first position.

16. The electrical switching apparatus of claim 15 wherein the first interior surface of said housing includes a first edge having two first recesses, which are larger than the second notches of said first and second legs; wherein the second interior surface of said housing includes a second edge having two second recesses, which are larger than the second notches of said first and second legs; wherein said accessory tray includes a plurality of tabs; wherein the two first recesses of the first edge are structured to overlay two of said tabs of said accessory tray; and wherein the two second recesses of the second edge are structured to overlay two of said tabs of said accessory tray.

* * * * *